US007712800B2

(12) United States Patent
Peng

(10) Patent No.: US 7,712,800 B2
(45) Date of Patent: May 11, 2010

(54) FIREPROOF DOOR LOCK ASSEMBLY

(75) Inventor: Fu-Chang Peng, Shulin (TW)

(73) Assignee: Fu Chang Locks WFG Corp., Shulin, Taipei Count (TW)

( * ) Notice: Subject to any disclaimer, the term of this patent is extended or adjusted under 35 U.S.C. 154(b) by 83 days.

(21) Appl. No.: 12/017,046

(22) Filed: Jan. 20, 2008

(65) Prior Publication Data

US 2009/0183538 A1 Jul. 23, 2009

(51) Int. Cl.
*E05B 65/10* (2006.01)

(52) U.S. Cl. ..... 292/92; 292/DIG. 65; 292/DIG. 66

(58) Field of Classification Search ..... 292/92, 292/DIG. 65, DIG. 66, 4–6, 56–67, 70, 71, 292/194, 214–218; 49/394, 395; 70/92
See application file for complete search history.

(56) References Cited

U.S. PATENT DOCUMENTS 5,253,905 A * 10/1993 Hutson ..... 292/92
5,490,696 A * 2/1996 Hutson ..... 292/92
6,854,773 B2 * 2/2005 Lin ..... 292/92
7,044,510 B2 * 5/2006 Lin ..... 292/93
7,070,210 B2 * 7/2006 Lin ..... 292/93
7,144,050 B2 * 12/2006 Lin ..... 292/93
7,287,784 B2 * 10/2007 Lin ..... 292/92
2004/0124640 A1 * 7/2004 Lin ..... 292/93
2004/0227351 A1 * 11/2004 Lin ..... 292/92

* cited by examiner

*Primary Examiner*—Peter M. Cuomo
*Assistant Examiner*—Mark Williams

(57) ABSTRACT

An fireproof door lock assembly comprises a handle seat frame being a U shape frame; a press unit installed in the U shape frame of the handle seat frame; the press unit having a driven mechanism; the driven mechanism including a driven unit; a plurality of buckling units, an elastic unit, at least one vibration reduction element, at least one driving bodies, a bottom plate and a pin unit; a press element having an L shape and being attached to the driving body by using a plurality of studs passing through a connecting unit, the press element and a driving unit; and fireproof door lock installed in front of the handle seat frame; so that the driven mechanism of the press unit having the effect of opening the fireproof door look.

4 Claims, 8 Drawing Sheets

FIREPROOF DOOR LOCK ASSEMBLY

FIELD OF THE INVENTION

The present invention relates to door locks, and particularly to a fireproof door lock assembly, wherein the driven mechanism of a press unit can be used to open or close a fireproof door lock. Furthermore, the driving body is combined with a spring and vibration reduction elements so as to have the effect of fast restoration and vibration reduction. Furthermore, a pin unit is used to help the operation of a latch of a door.

BACKGROUND OF THE INVENTION

Generally, in operation of a fireproof door lock, a press handle in a handle frame of the fireproof doorplate is pressed so that the lock stud in the lock casing is reduced inwards. Thus the door lock will release and thus is opened. However the handle slides along an inclined recess track at one of two sides of a retaining seat in the handle frame seat. The user must apply a great force and only the vertical component of the force is effective. Furthermore, if the force is too great, the lock will be locked.

Besides, no structure can provide proper restoring force to the retaining seat, when it is desired to close an opened lock, the operation is not smooth.

SUMMARY OF THE INVENTION

Accordingly, the primary object of the present invention is to provide a fireproof door lock assembly, wherein the driven mechanism of a press unit can be used to open or close a fireproof door lock. Furthermore, the driving body is combined with a spring and vibration reduction elements so as to have the effect of fast restoration and vibration reduction. Furthermore, a pin unit is used to help the operation of a latch of a door.

To achieve above objects, the present invention provides an fireproof door lock assembly comprising a handle seat frame being a U shape frame; a press unit installed in the U shape frame of the handle seat frame; the press unit having a driven mechanism; the driven mechanism including a driven unit; a plurality of buckling units, an elastic unit, at least one vibration reduction element, at least one driving bodies, a bottom plate and a pin unit; a press element having an L shape and being attached to the driving body by using a plurality of studs passing through a connecting unit, press element and driving unit; and fireproof door lock installed in front of the handle seat frame; so that the driven mechanism of the press unit having the effect of opening the fireproof door look.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
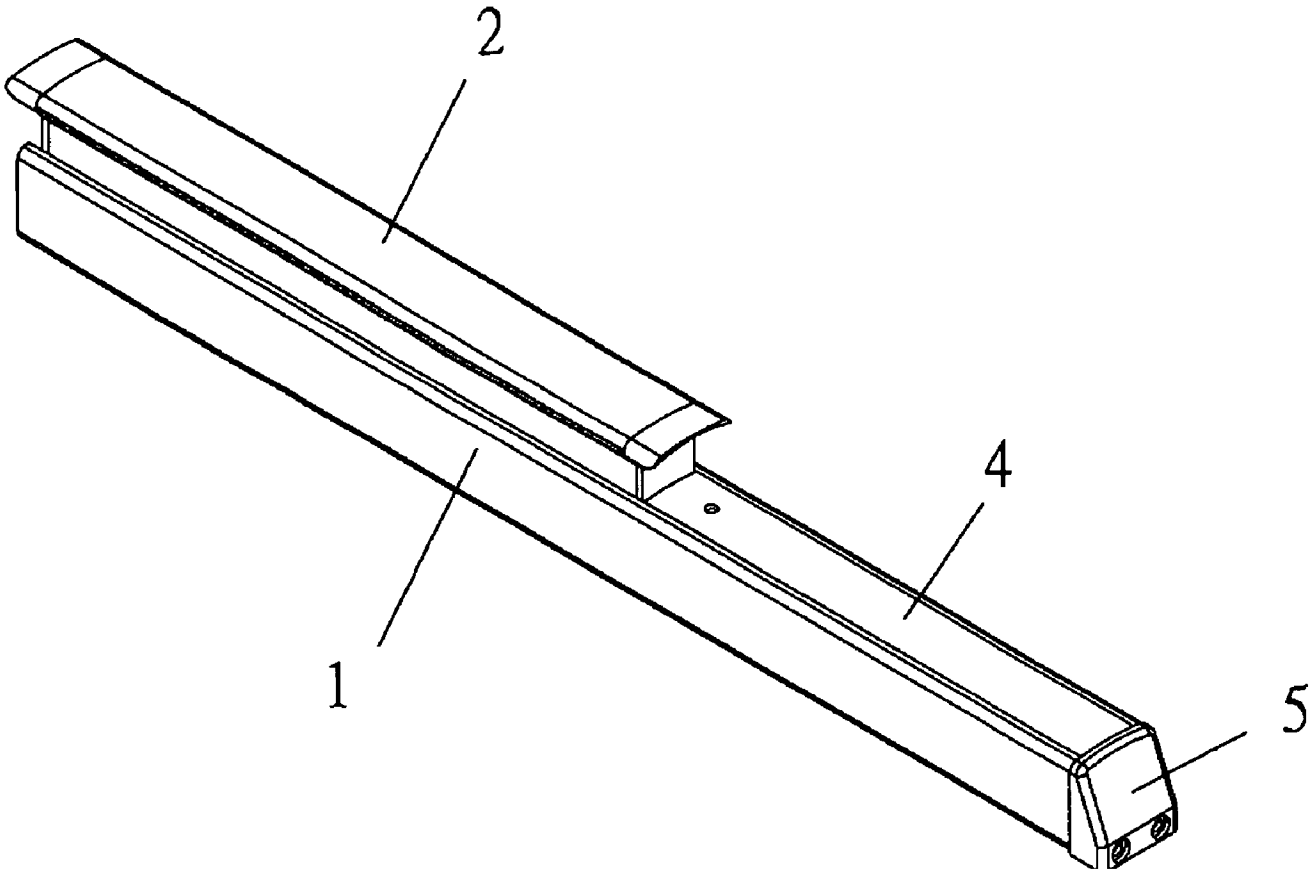
FIG. 1 is a perspective view of the present invention.
Figure 2:
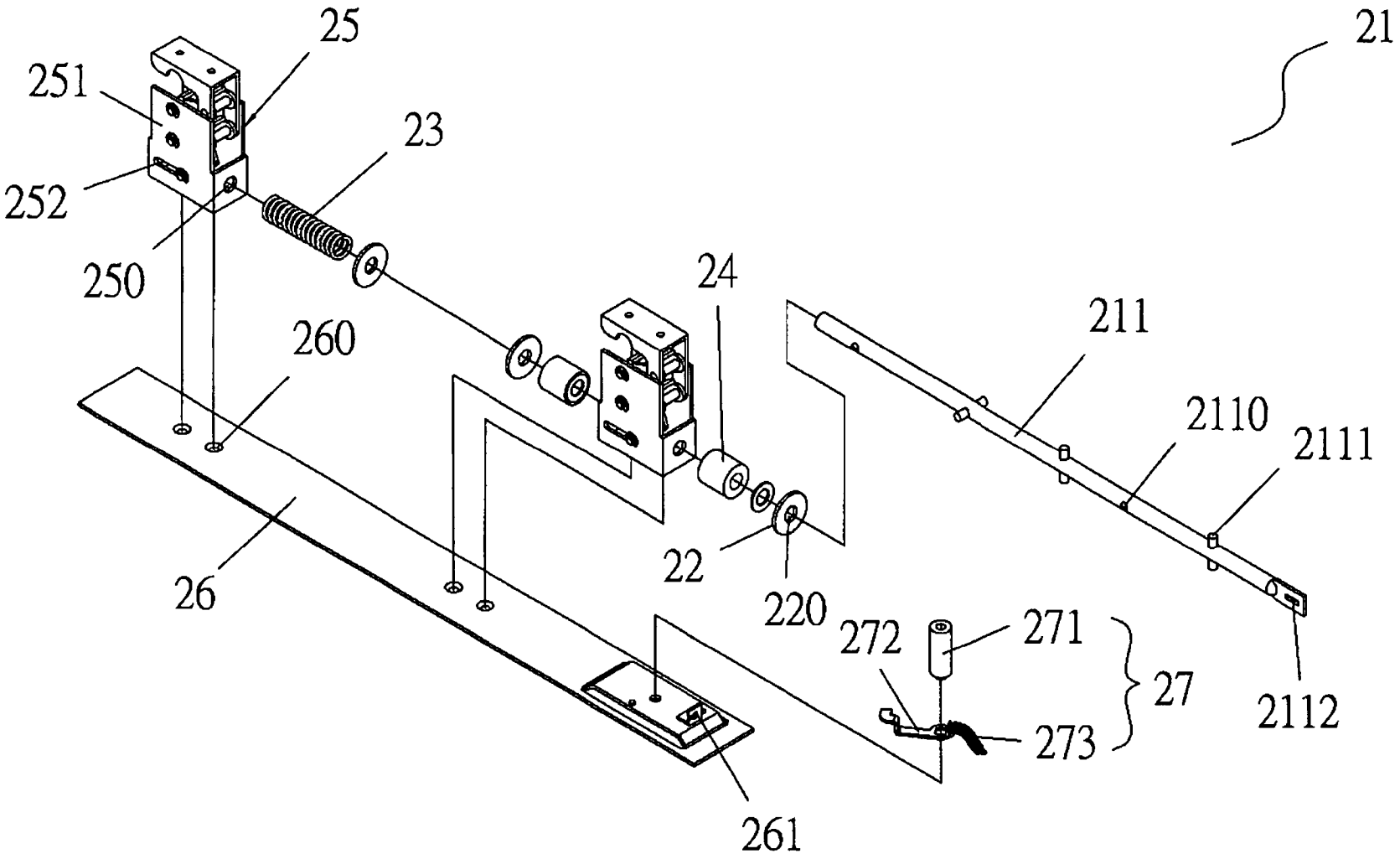
FIG. 2 is an exploded perspective view of the driven mechanism of the present invention.
Figure 7:
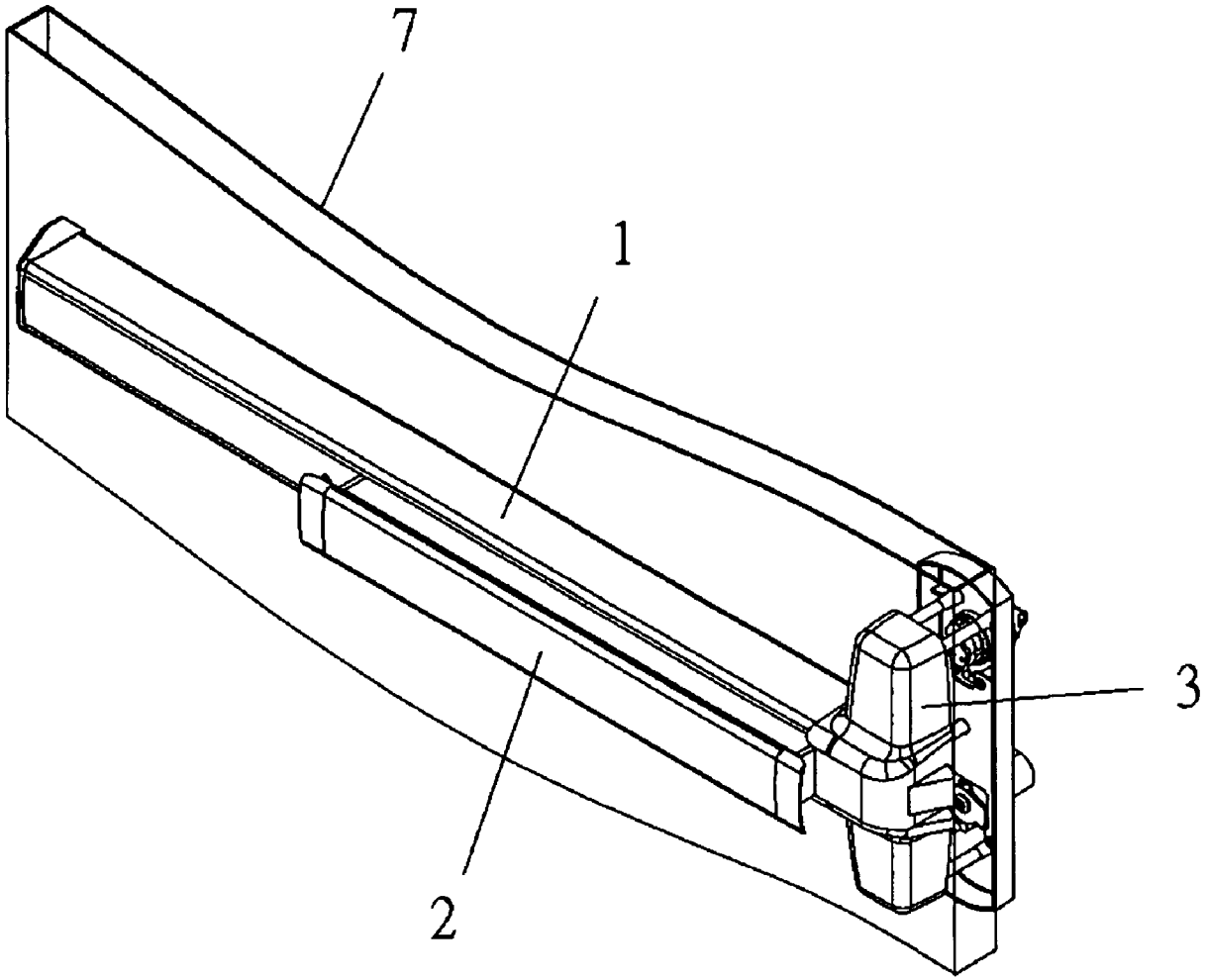
FIG. 7 is a schematic view showing one embodiment of the present invention.

Referring to FIGS. 1, 2, and 7, the structure of the present invention will be described herein.

A handle seat frame 1 is a U shape frame.

A press unit 2 is installed in the U shape frame of the handle seat frame 1. The press unit 2 has a driven mechanism 21. The driven mechanism 21 includes a driven unit 25, a plurality of buckling units 22, an elastic unit 23, at least one vibration reduction element 24 (in this embodiment, there are two vibration reduction elements 24 are illustrated), at least one driving bodies 25, a bottom plate 26 and a pin unit 26. The driven unit 25 includes a linkage rod 211 which has a plurality of stud holes 2110 for receiving respective studs 2111. One end of the linkage rod 211 has a via hole 2112 at one end thereof. Each buckle unit 22 has a through hole 220 for combining with the elastic unit 23 and the vibration reduction elements 24. A plurality of studs 2111 are used to lock the buckle unit 22 to the vibration reduction element 24. The linkage rod 211 passes through the two buckle units 22, the elastic unit 23, the vibration reduction element 24 and the two driving body 25. The driving body 25 has a recessed seat 251. Two sides of the recessed seat 251 have a plurality of stud holes 250 and a plurality of displace grooves 252. The bottom plate 26 is formed with a through hole 260 and a buckle sheet 261. The bottom plate 26 serves to support the driving bodies 25 by using screws to lock the bottom plate 26 and the driving bodies 25. The pin unit 26 includes a pivotal unit 271, a hook 272 and a spring 273.

Figure 4:
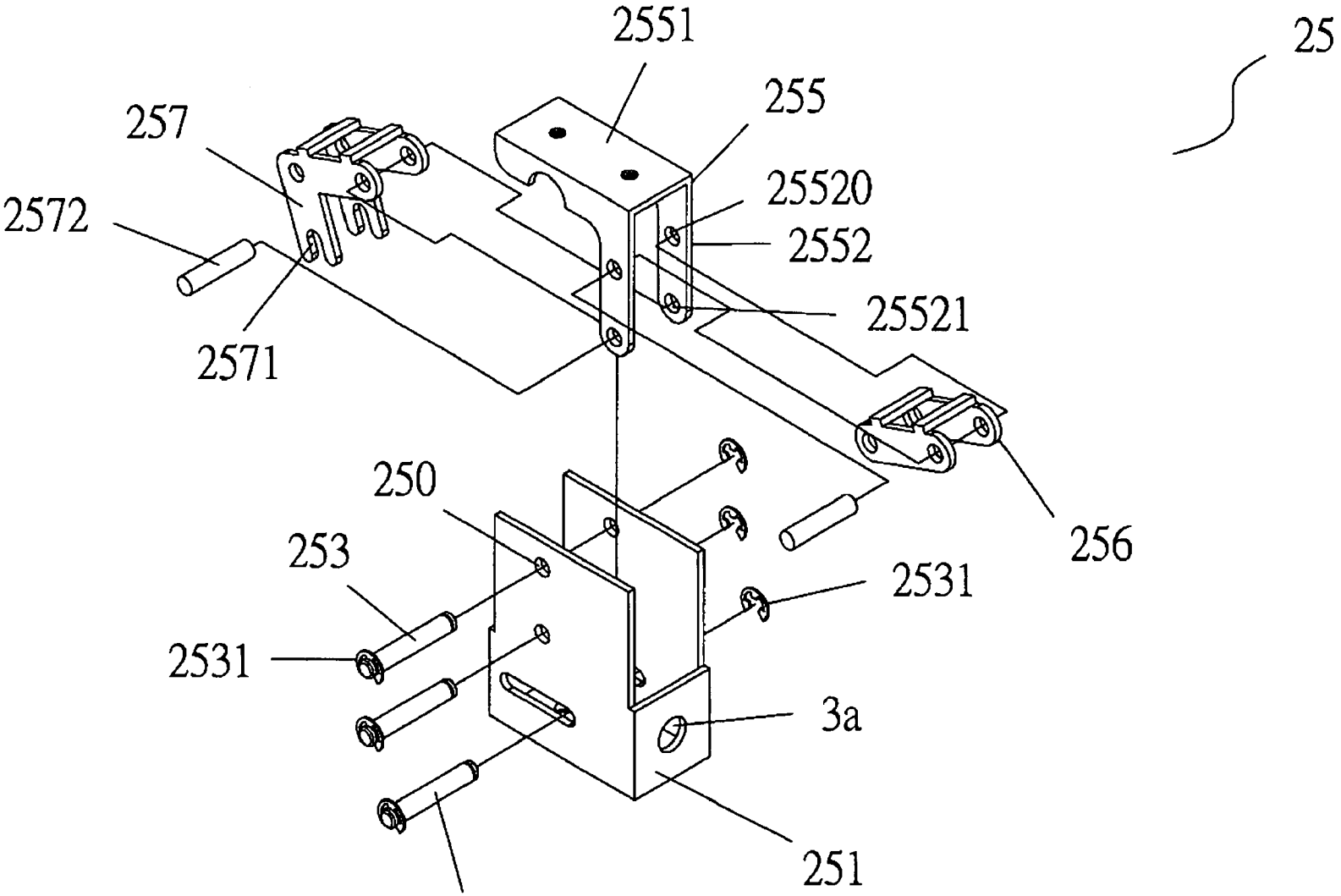
FIG. 4 is an explosive schematic view of the driving body of the present invention.

Referring to FIG. 4, a press element 255 has an L shape is attached to the driving body 25 by using a plurality of studs 253 passing through a connecting unit 256, press element 255 and driving unit 25 so as to pivotally fix the press element 255 to the driving unit 25 and a plurality of studs 253 passing through a driving assembly 257, the press element 255 and the linkage rod 211 so as to pivotal fix the press element 255 to the linkage rod 211. A C ring 2531 is installed between one end of the stud 253 and a lateral side of the driving unit 25.

An upper plane 2551 of the driving body 25 is in contact with an upper sheet of the press unit 2 and another end thereof is extended downwards with two extending sheets 2552. Each extending sheet 2552 is formed with an upper through hole 25520 and a lower through hole 25521. The upper through hole 25520 serves to connect with one end of the connecting unit 256. Another end of the connecting unit 256 is combined with the recessed seat 251. The lower through hole 25521 serves to connect with one end of the driving assembly 257. The driving assembly 257 has an L shape. Another end of the driving assembly is formed with a slot 2571. A stud 2572 serves to combine the driving assembly 257 to the displace groove 252 of the recessed seat 251.

A fireproof door lock 3 is installed in front of the handle seat frame 1. The driven mechanism 21 of the press unit 2 has the effect of opening the fireproof door look 3.

The press unit 2 is combined to the U shape handle seat frame 1 and then the handle seat frame 1 is combined with a cover plate 4 and a buckle 5.

Figure 3:
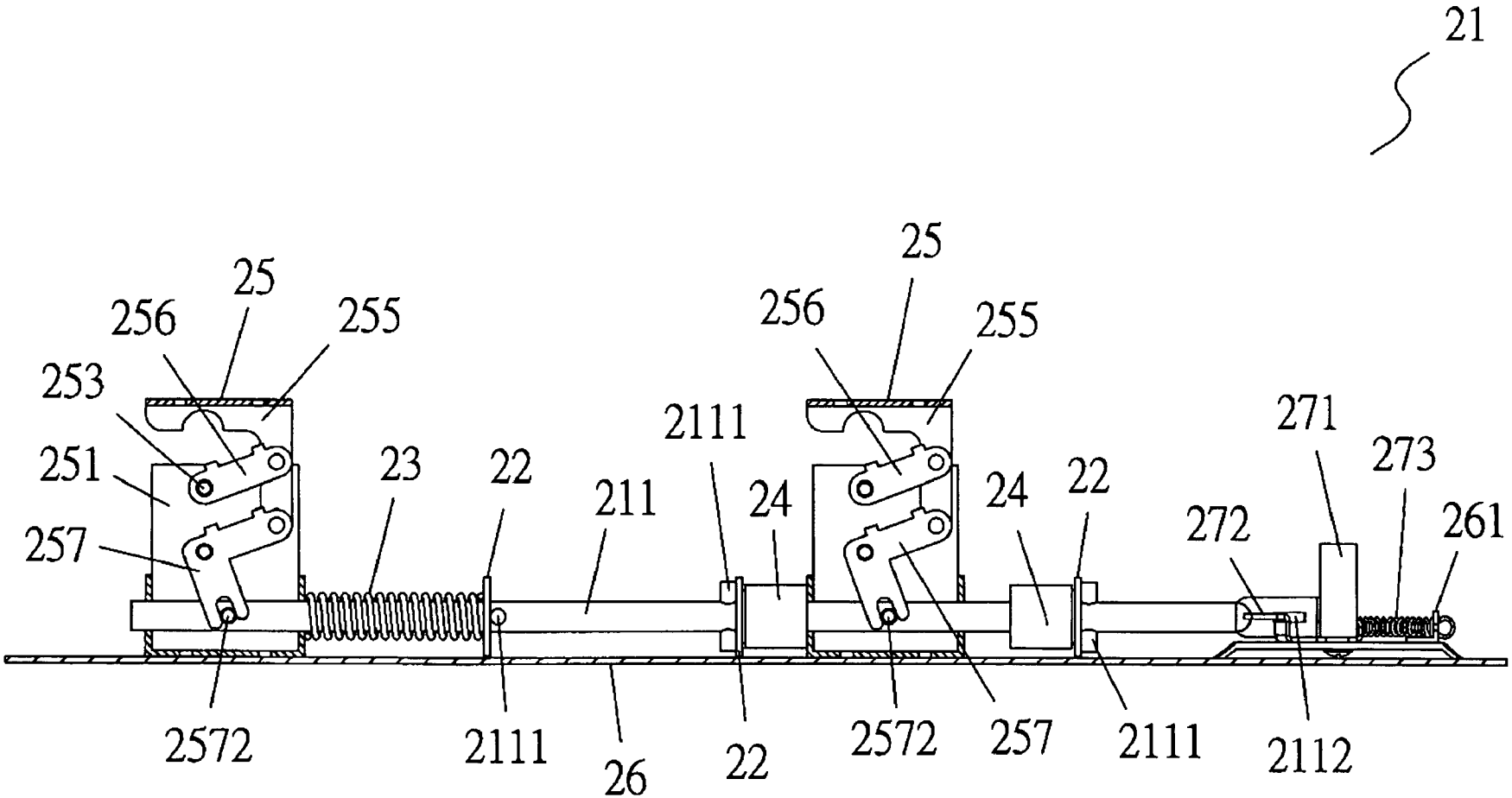
FIG. 3 is a lateral view of the driven mechanism of the present invention.
Figure 5:
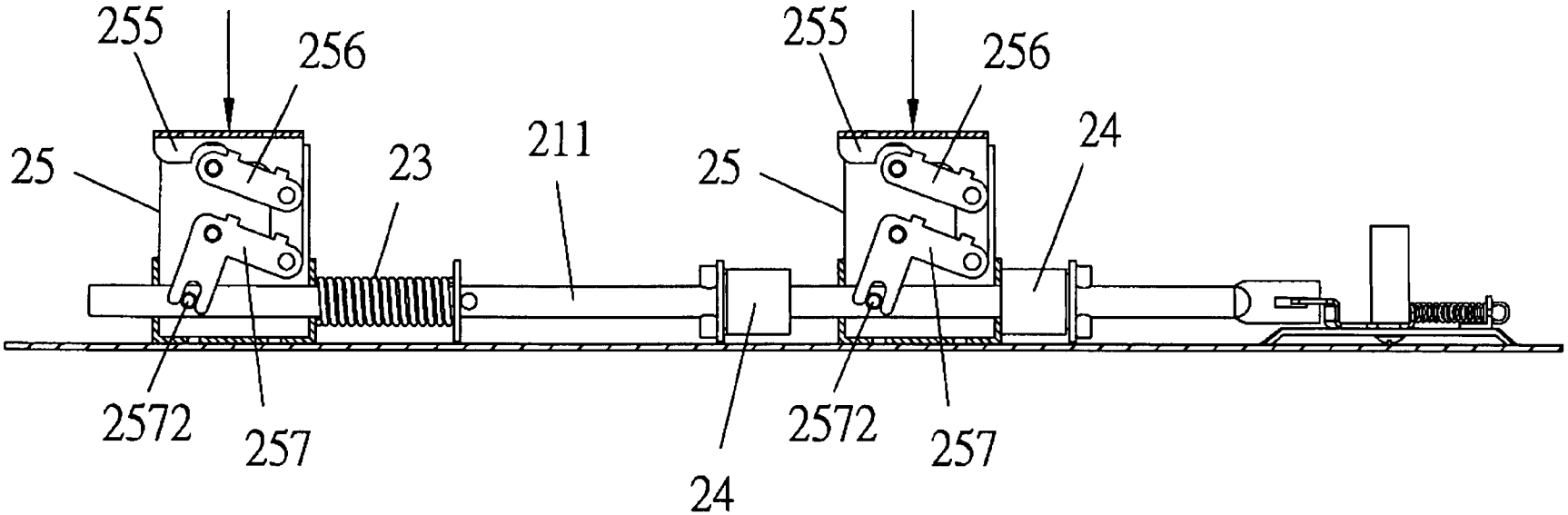
FIG. 5 shows the operation of the driven mechanism of the present invention.

Referring to FIGS. 1, 3 and 5, when the press unit 2 is pressed, the press element 255 of the press unit 2 is pressed to resist against the connecting unit 256. Another end thereof will drive the driving assembly 257 to make the linkage rod 211 move through the insertion studs 2572 so as to drive another driving body 25. The spring 273 between two driving bodies 25 are compressed. When the vibration reduction element 24 contacts the driving body 25, the press unit 2 is released. The spring 273 will return to the original position and the two driving bodies restores.

Figure 6:
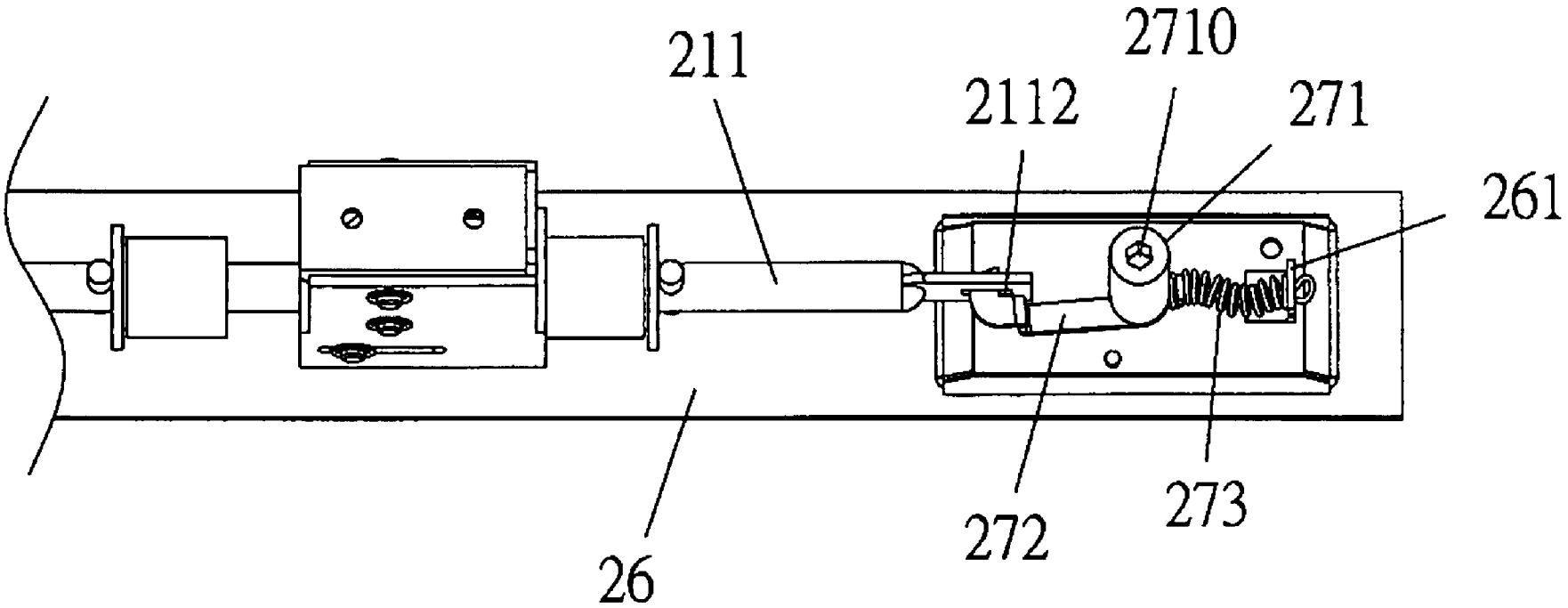
FIG. 6 is an elevational view of the pin unit of the present invention.
Figure 8:
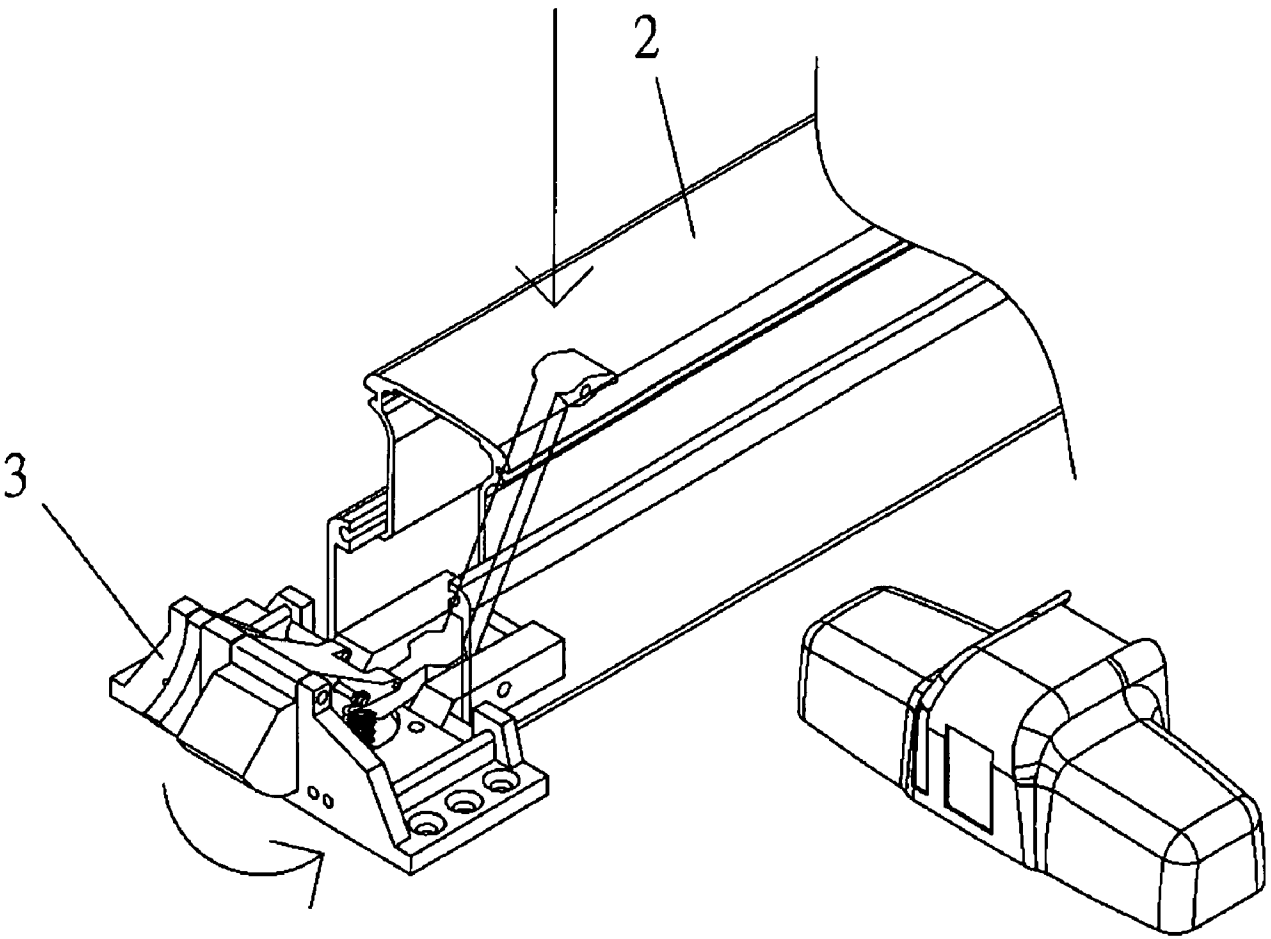
FIG. 8 is a schematic view about the operation of the embodiment of the present invention.

Referring to FIGS. 6, 7 and 8, in the pin unit 27 of the present invention, a pivotal unit 271 is combined with a hook 272 on the bottom plate 26. One end of the hook 272 is connected with one end of the spring 273 and another end of the spring 273 is assembled to the buckle sheet 261 of the bottom plate 26. The pivotal unit 271 has an hexagonal hole 2710. When it is desired to retain the fireproof door lock 3 in an open state, the press unit 2 is pressed to open the fireproof door lock 3. Then the pivotal unit 271 is adjusted to hook the via hole 2112 of the linkage rod 211 so as to fix the fireproof door lock 3 in an open position.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A fireproof door lock assembly, comprising:

a handle seat frame being a U shape frame;

a press unit installed in the U shape frame of the handle seat frame; the press unit having a driven mechanism; the driven mechanism including a driven unit, a plurality of buckling units, an elastic unit, at least one vibration reduction element, at least one driving bodies, a bottom plate and a pin unit; the driven unit including a linkage rod which has a plurality of stud holes for receiving respective studs; one end of the linkage rod having a via hole at one end thereof; each buckle unit having a through hole for combining with the elastic unit and the vibration reduction elements; the linkage rod passing through the two buckle units, the elastic unit, the vibration reduction element and the two driving bodies; the driving body having a recessed seat; two sides of the recessed seat having a plurality stud holes and a plurality of displace grooves; the bottom plate being formed with a through hole and a buckle sheet; the bottom plate serving to support the driving bodies by using screws to lock the bottom plate and the driving bodies;

a press element having an L shape and being attached to the driving body by using a plurality of studs passing through a connecting unit, the press element and the driving unit so as to pivotally fix the press element to the driving unit and a plurality of studs passing through a driving assembly, the press element and the linkage rod so as to pivotal fix the press element to the linkage rod; a C ring being installed between one end of the stud and a lateral side of the driving unit;

an upper plane of the driving body being in contact with an upper sheet of the press unit and another end thereof being extended downwards with two extending sheets; each extending sheet being formed with an upper through hole and a lower through hole; the upper through hole serving to connect with one end of the connecting unit; another end of the connecting unit is combined with the recessed seat; the lower through hole serves to connect with one end of the driving assembly; the driving assembly having an L shape; another end of the driving assembly being formed with a slot; a stud serving to combine the driving assembly to the displace groove of the recessed seat;

a fireproof door lock installed in front of the handle seat frame; the driven mechanism of the press unit having the effect of opening the fireproof door look; and the press unit combined to the U shape handle seat frame and then the handle seat frame being combined with a cover plate and a buckle; and when the press unit is pressed, the press element of the press unit is pressed to resist against the connecting unit; another end thereof will drive the driving assembly to make the linkage rod move through the insertion studs so as to drive another driving body; the spring between two driving bodies are compressed; when the vibration reduction element contacts the driving body, the press unit is released; and the spring will return to the original position and the two driving bodies restores.

2. The fireproof door lock assembly as claimed in claim 1, wherein two sides of the driving body are installed with respective vibration reduction elements; and a plurality of studs being used to lock the buckle unit to the vibration reduction element.

3. The fireproof door lock assembly as claimed in claim 1, wherein a press element has an L shape and is attached to the driving body by using a plurality of studs passing through a connecting unit, the press element and the driving unit so as to pivotally fix the press element to the driving unit and a plurality of studs passing through a driving assembly, the press element and the linkage rod so as to pivotal fix the press element to the linkage rod; a C ring is installed between one end of the stud and a lateral side of the driving unit.

4. The fireproof door lock assembly as claimed in claim 1, wherein in the pin unit, a pivotal unit is combined with a hook on the bottom plate; one end of the hook is connected with one end of the spring and another end of the spring is assembled to the buckle sheet of the bottom plate; the pivotal unit has an hexagonal hole; when it is desired to retain the fireproof door lock in an open state, the press unit is pressed to open the fireproof door lock; then the pivotal unit is adjusted to hook the via hole of the linkage rod so as to fix the fireproof door lock in an open position.

* * * * *